US005967913A

United States Patent [19]

Sulenta

[11] Patent Number: 5,967,913

[45] Date of Patent: Oct. 19, 1999

[54] CONFIGURED AND ADJUSTABLE GRIP FOR GAME STICK

[75] Inventor: John A. Sulenta, P.O. Box 432, Pinedale, Wyo. 82941

[73] Assignee: John A. Sulenta, Pinedale, Wyo.

[21] Appl. No.: 08/994,375

[22] Filed: Dec. 19, 1997

[51] Int. Cl.[6] ..... A63B 59/12

[52] U.S. Cl. ..... 473/560; 473/449; 473/552

[58] Field of Search ..... 473/549, 552, 473/560, 559, 568, 300, 298, 299, 295, 313, 314; 81/177.1; 16/110 R, 111 R; 84/422.4

[56] References Cited

U.S. PATENT DOCUMENTS

| | | | |
|---|---|---|---|
| D. 244,219 | 5/1977 | Poirier . | |
| 2,040,132 | 5/1936 | Hall . | |
| 3,219,348 | 11/1965 | Dishner, Jr. | 473/313 X |
| 3,586,080 | 6/1971 | Slany | 81/177.1 X |
| 4,002,207 | 1/1977 | Bartz | 16/110 R X |
| 4,101,125 | 7/1978 | Heath | 473/552 |
| 4,445,687 | 5/1984 | Merritt | 473/564 |
| 4,600,193 | 7/1986 | Merritt . | |
| 4,969,231 | 11/1990 | Mader et al. | 81/177.1 X |
| 5,306,003 | 4/1994 | Pagotto . | |
| 5,636,836 | 6/1997 | Carroll et al. | 473/561 |
| 5,696,339 | 12/1997 | Brennan | 84/422.4 |

FOREIGN PATENT DOCUMENTS

| | | |
|---|---|---|
| 8502-691 | 5/1987 | Netherlands . |
| 2-018-138 | 10/1979 | United Kingdom . |

*Primary Examiner*—Raleigh W. Chiu
*Attorney, Agent, or Firm*—Thorpe, North & Western

[57] ABSTRACT

A game stick, such as a hockey stick, has a configured and adjustable grip. The configured grip has a triangular cross section with three sides and three edges. The grip is oriented with respect to a striking portion of the stick. The stick may also have a configured handle. The grip and handle may have different configurations and different orientations with respect to the striking portion. The grip and handle are detachably or adjustably coupled to the striking portion so that the orientation of the grip and/or handle may be reversed or changed.

22 Claims, 4 Drawing Sheets

CONFIGURED AND ADJUSTABLE GRIP FOR GAME STICK

BACKGROUND OF THE INVENTION

1. Field of the Invention

The present invention relates to a configured and adjustable game stick grip, particularly well suited for hockey sticks, with a triangular cross section and two or more orientations with respect to a blade or striking portion of a game stick. More particularly, the present invention relates to a configured game stick grip having a triangular cross section with three sides and three edges for preventing rotation and providing a recognizable orientation with respect to the blade in the hand of a player. In addition, the present invention relates to an adjustable game stick grip adjustably coupled to the blade for providing at least two orientations of the grip with respect to the blade.

2. Prior Art

Many games involve the use of a game stick to strike or otherwise direct a ball or game piece. Such game sticks usually have a blade or striking portion with a striking surface. This blade is disposed on the end of an elongated handle that has a grip on the other end with which the player grasps the game stick. Alternatively, the grip may extend the length of the handle, or the entire handle may serve as the grip. Effective and accurate use of the game stick typically requires that the striking surface be properly oriented with respect to the game piece, which in turn requires that the grip or handle be properly oriented in the players hand. In addition, it is necessary that the grip or handle remain properly oriented, especially when the game stick is used with great force striking a game piece with the gamestick produces forces tending to rotate the stick in the player's hand. Furthermore, it is also desirable that the grip or handle fit comfortably in the players hand because the game stick is held for the length of the game.

For example, ice hockey is a popular sport played by many people ranging from young children to professional athletes. Hockey is typically played on enclosed rinks by attempting to shoot a puck through a goal located at either end of the rink, known as a cage. The players wear skates and strike the puck with a stick in order to move it across the rink and into the cage. During play, the puck is often passed back and forth between players and shot at the cages. Accurately passing or shooting the puck with the stick requires a great degree of skill. Therefore, it is important for the player's hockey stick to enhance the player's skill or at least not unduly interfere or impede the player's ability. In addition, the puck is often shot at the goal with a great deal of force. Therefore, it is important for the player's hockey stick to capably handle the applied forces.

The hockey stick usually has an elongated handle with a grip at a proximal end and a blade at a distal end. The stick is grasped by the player at the grip and at the handle. The blade extends from the handle and has a striking surface used for contacting the puck. The blade is used to guide the puck across the ice as the player skates. In addition, the blade strikes the puck in order to pass the puck to another player or to shot the puck at the goal. The blade is usually formed of wood and may be reinforced with a fiber and epoxy matrix. The blade is also sometimes formed from a plastic material. The handle is also usually formed of wood and may also be reinforced with a fiber and epoxy matrix. The hockey stick typically is provided as an integral unit, with the blade either integrally formed with the handle or otherwise permanently fastened to the handle.

The grip is formed at one end of the handle and wrapped with a tape material for an improved grip. Typically, the grip is little more than an extension of the proximal end of the handle wrapped in tape. Players may hold the handle by the grip with one hand, but usually grasp the handle with both hands, one hand grasping the grip and the other grasping the handle past the grip. In this sense, the entire handle forms the grip of the stick. Passing and shooting the puck usually requires holding the stick with both hands.

The handle is usually formed of an elongated shank with a rectangular cross section. As mentioned above, the grip is usually nothing more than the proximal end of the handle, and thus shares the same rectangular cross section. The handle, and grip, have four surfaces, two elongated surfaces generally facing in the same direction as the striking surface of the blade and a back of the blade, respectively, and two shorter surfaces each located between and perpendicular to the longer surfaces. A radius of curvature is formed between each of the surfaces.

One problem with typical hockey sticks is the difficulty of adequately and comfortably grasping the grip and handle. In order to accurately pass the puck and powerfully shoot the puck with the stick, it is necessary to effectively grasp and control the hockey stick. The broad surfaces of the rectangular cross section provide some degree of orienting the stick within the hands of the player and preventing the stick from rotating or twisting.

The rectangular cross section, however, fits unnaturally in the player's hands. The two broad surfaces and two narrow surfaces do not effectively match the surfaces created by the closed hand. The result is that the blade itself is not properly oriented with respect to the puck for effectively passing or shooting the puck. The player must correct for this misorientation by twisting the wrists or rotating the body or upper torso so that the blade is properly oriented.

In addition, the mismatch between the rectangular stick and hands means that the stick must be gripped with an unnecessary amount of force to prevent rotation of the stick within the hands. Furthermore, when the stick strikes the puck with great force, such as during shooting, the force tends to rotate the stick within the hands, thus causing inaccurate shooting.

Other examples of games requiring game sticks include, street hockey, roller hockey, field hockey, ringuette, etc. The game sticks used in these games face many similar problems as those identified above.

Limited efforts have been directed towards improving hockey stick designs or game stick designs. U.S. Pat. No. 5,306,003, issued Apr. 26, 1994, to Pagotto, discloses a hockey stick with a handle having a generally rectangular cross section including four sides and four edges. The two upper edges have a larger radius of curvature than the two lower edges. U.S. Pat. No. 5,577,725, issued Nov. 26, 1996, to Pagotto et al. discloses a hockey stick with a handle having upper and lower gripping zones. Each zone of the handle has a generally rectangular cross section with the longer sides having concave and convex faces. Each zone is reversed relative to the other to accommodate each hand of the player. One disadvantage of the above handles is that they maintain the traditional rectangular cross section. As discussed above, the rectangular cross section does not fit naturally in the player's hand and is difficult to adequately and comfortably grasp.

Therefore, it would be advantageous to develop a grip capable of properly orienting the game stick in the player's hands so that the striking surface is properly oriented with respect to the game piece. It would also be advantageous to develop a grip capable of remaining properly oriented. It would also be advantageous to develop a grip that conforms more naturally to the player's hand. It would also be advantageous to develop a grip that is comfortable. It would also be advantageous to develop a grip with different orientations with respect to the striking surface to suit the needs and desires of the player. It would also be advantageous to develop a grip with multiple configurations and/or multiple orientations to suit each of the player's hands.

OBJECTS AND SUMMARY OF THE INVENTION

It is an object of the present invention to provide a grip configured to properly orient a game stick in the players hand.

It is another object of the present invention to provide a grip configured to maintain the proper orientation.

It is yet another object of the present invention to provide a grip configured for conforming naturally to the player's hand.

It is yet another object of the present invention to provide a grip configured for comfortably fitting in the player's hand.

It is yet another object of the present invention to provide a grip with different orientations with respect to the striking surface of a game stick to suit the player's desires.

It is yet another object of the present invention to provide a grip adjustable between different orientations.

It is yet another object of the present invention to provide a grip with multiple configurations and/or multiple orientations for each of the player's hands.

It is a further object of the present invention to provide such a configured and adjustable grip for a hockey stick.

These and other objects and advantages of the present invention are realized in a game stick, such as a hockey stick, having a configured and adjustable grip and/or handle. Game sticks, and in particular hockey sticks, have a striking portion or blade disposed on the end of an elongated handle. A grip is formed on the other end of the handle and may extend the length of the handle.

The grip has a triangular cross section with three sides and three edges. The triangular cross section is preferably equilateral with sides of equal length, but may be right, isosceles, or acute and have sides of differing lengths. The edges are preferably rounded. The configured grip fits comfortably and naturally in the player's hand.

The grip may be oriented so that one of the sides faces, or one of the edges points forward, rearward, upward, downward, or in any other desired direction. The grip is oriented with respect to the blade so that blade is properly oriented with respect to a puck.

The grip, with its triangular cross section, may extend along a portion of the handle. Thus, both the player's hands may engage the stick at a configured portion.

In an alternative embodiment, the stick may have an upper grip portion generally corresponding to the grip and a lower grip portion generally corresponding to the handle. The upper grip portion may have one configuration, for example rectangular, while the lower grip portion has another configuration, for example triangular, or vice versa. Thus, the grip and handle may be naturally and comfortably held by both the player's hands.

In addition, the upper grip portion may have one orientation, for example a triangular configuration with one side facing forward, while the lower grip portion has another orientation, for example a triangular configuration with one side facing rearward. Thus, the grip and handle may be oriented in the player's hands so that the blade is properly oriented with respect to the puck.

The handle may be permanently and fixedly attached to the blade, but is preferably adjustably and/or detachably coupled to the blade. The conventional handle has a female rectangular receiver for receiving a male rectangular receiver of the conventional blade. On a conventional rectangular handle, removing the blade from the handle and rotating it 180 degrees will not affect the orientation of the handle with respect to the blade. On a triangular handle, however, removing the blade, rotating the handle 180 degrees, and reinserting the blade into the receiver will reverse, or change, the orientation of the grip and/or handle. The triangular receiver and handle end provide two different orientations.

Alternatively, the receiver may be square, thus providing four different orientations. In addition, the receiver may be circular, thus providing an infinite number of angular orientations between the handle and/or grip and the blade.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
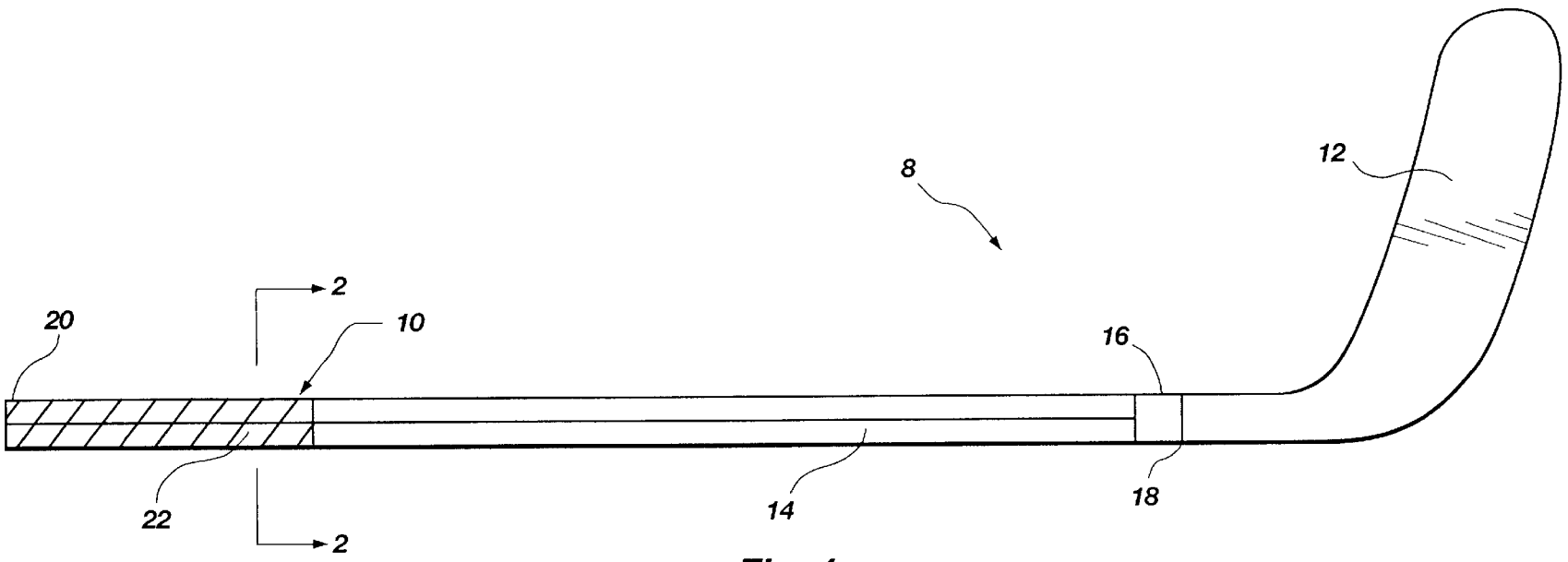
FIG. 1 is a side view of a hockey stick incorporating a preferred embodiment of a grip of the present invention.

As illustrated in FIG. 1, a hockey stick, indicated generally at 8, is shown incorporating the configured and adjustable grip of the present invention, indicated generally at 10. The hockey stick 8 has a blade 12 with a striking surface (not shown). The blade 12 and striking surface are adapted for striking a hockey puck. The hockey stick 8 has an elongated handle 14. The handle 14 is an elongated shank and has a distal end 16 coupled to the blade 12 at a connection 18. The handle also has a proximal end 20.

The grip 10 is formed on the proximal end 20 of the stick 8. The grip 10 is an elongated shank or shaft, much like the handle, and may be an extension of the handle. The grip 10 may be wrapped with tape 22 or another sticky substance to improve the player's ability to hold the stick.

The term "grip" refers to the proximal end of the handle as well as to the handle, or portion of the handle, itself because the stick is typically grasped not only by the proximal end of the handle, but along the length of the handle as well. The hockey stick 8 is representative of many types of game sticks generally having a handle and a striking portion. Although a hockey stick is specifically represented, it is of course understood that the configured and adjustable grip 10 of the present inanition may be incorporated by various other game sticks, including for example field hockey sticks and ringuette sticks.

Figure 2:
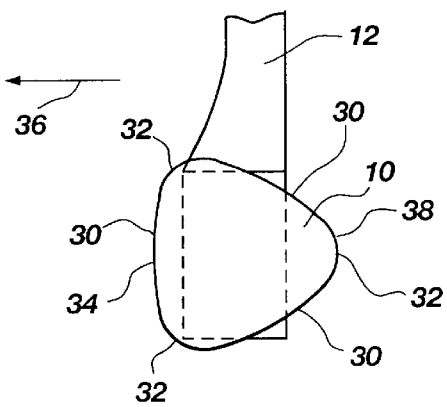
FIG. 2 is a cross sectional view of the preferred embodiment of the grip of the present invention in a first orientation taken along line 2—2 of FIG. 1.

As illustrated in FIG. 2, the grip 10 advantageously has a generally triangular cross section, including three sides 30 and three edges 32. One advantage of the triangular cross section is that the grip has a more natural and comfortable fit in the player's hands. Another advantage of the configured grip is that less energy is required to grasp or hold the stick to prevent it from turning or rotating in the player's hands. Another advantage of the configured grip is that the triangular cross section allows the grip to be held in a proper orientation with respect to the blade. Thus, the player's hands and body do not have to turn or rotate to align the blade with the puck. Another advantage of the configured grip is that it provides a more recognizable orientation with respect to the blade so that the player may be sure of the blade's orientation without having to take his or her eyes off the game.

The sides 30 of the configured grip 10 preferably have a generally curved surface. The curved surface of the sides 30 is preferably slightly convex. The convex sides 30 are raised preferably between 0 and 0.3 inches, more preferably between 0 and 0.1 inches, and most preferably 0.05 inches. Alternatively, the sides 30 may have a generally planar surface or may be concave. Furthermore, some of the sides may be curved whiles others are planar, or some may be convex and others concave.

The edges 32 of the configured grip 10 preferably have a rounded surface. The rounded surface of the edges 32 has a radius of curvature preferably between ⅛ and ¼ inches, and more preferably 3⁄16 inches. In addition, the edges 32 preferably all have the same radius of curvature. Alternatively, the edges 32 may be pointed, chamfered, or beveled. Furthermore, the radius of curvature may be different for some of the edges.

The grip 10 has a circumference of preferably between 3.5 and 3.75 inches, and more preferably 3.625 inches. Special grips made for younger players may have a smaller circumference, for example 90% smaller than the above, adult circumference. The above dimensions have been found to provide the most comfortable and natural fit for a player's hands. It is of course understood that the above dimensions do not limit the scope of the present invention, but are merely the best dimensions as presently contemplated.

The triangular cross section of the grip 10 is preferably equilateral, with all the sides 30 having the same length, as shown in FIGS. 2–5. Alternatively, the triangular cross section may be a right triangle, with two of the sides being generally perpendicular to one another, as shown in FIGS. 6–9. Furthermore, triangular cross section may be isosceles or acute and the sides need not have the same length.

Figure 3:
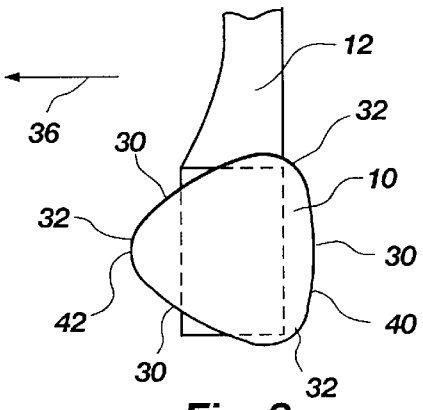
FIG. 3 is a cross sectional view of the preferred embodiment of the grip of the present invention in a second orientation.

Referring again to FIG. 2, one of the sides is preferably a forward side, indicated at 34, and is oriented so that it is generally parallel with the blade 12. Thus, this forward side 34 faces forward, or in the same direction as the striking surface, as indicated by arrow 36. One of the edges then becomes a rearward edge, indicated at 38, and points or faces rearward. As illustrated in FIG. 3, alternatively, one of the sides may be a rearward side, indicated at 40, and may be oriented to face rearward. One of the edges then becomes a forward edge, indicated at 42, and points or faces forward.

Figure 4:
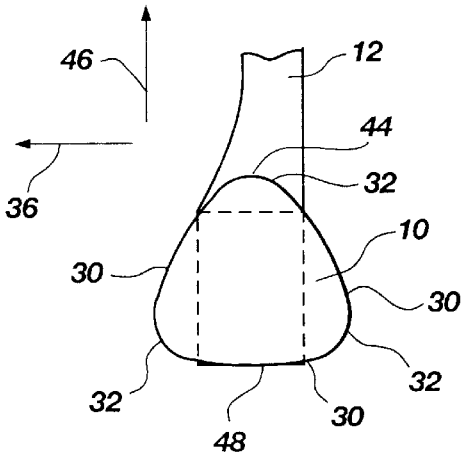
FIG. 4 is a cross sectional view of the preferred embodiment of the grip of the present invention in a third orientation.
Figure 5:
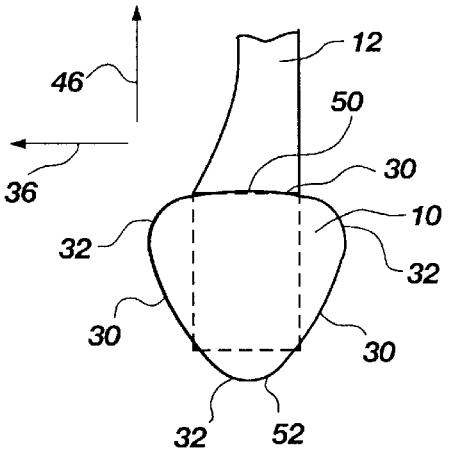
FIG. 5 is a cross sectional view of the preferred embodiment of the grip of the present invention in a fourth orientation.
Figure 6:
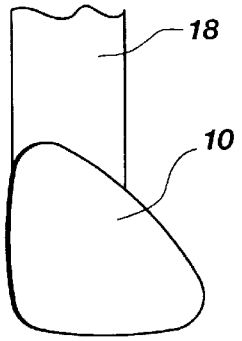
FIG. 6 is a cross sectional view of an alternative embodiment of the grip of the present invention in a first orientation.
Figure 7:
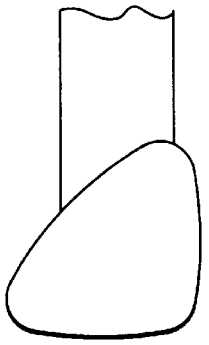
FIG. 7 is a cross sectional view of an alternative embodiment of the grip of the present invention in a second orientation.
Figure 8:
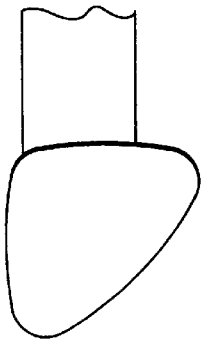
FIG. 8 is a cross sectional view of an alternative embodiment of the grip of the present invention in a third orientation.
Figure 9:
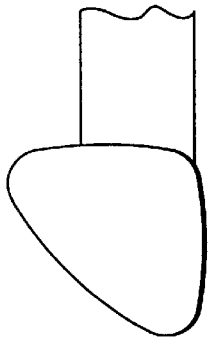
FIG. 9 is a cross sectional view of an alternative embodiment of the grip of the present invention in a fourth orientation.

It is of course understood that the grip 10 or the sides 30 may be oriented in many different ways with respect to the blade 12 or the forward direction 36. For example, as illustrated in FIG. 4, one edge is an upward edge, indicated at 44, and points or faces upward, as indicated by arrow 46. One of the sides then becomes a downward edge, indicated at 48, and faces downward. As illustrated in FIG. 5, one of the sides is an upward side, indicated at 50, and faces upward. One of the edges then becomes a downward edge, indicated at 52, and faces downward.

The sides 30 and edges 32 of the grip 10 may be oriented with respect to the blade 12, forward direction 36, or upward direction 46 as desired. By orienting the grip 10 with respect to the blade 12, the proper orientation of the blade 12 with respect to the puck may be obtained. Thus, the player does not have to rotate his or her hands to compensate for the hockey stick and properly orient the blade with respect to the puck. In addition, the most comfortable and natural fit of the grip in the player's hands may be obtained. The different orientations may be provided to suit different player's preferences. Referring again to FIGS. 6–9, the right triangular cross section may similarly have different orientations.

Figure 10:
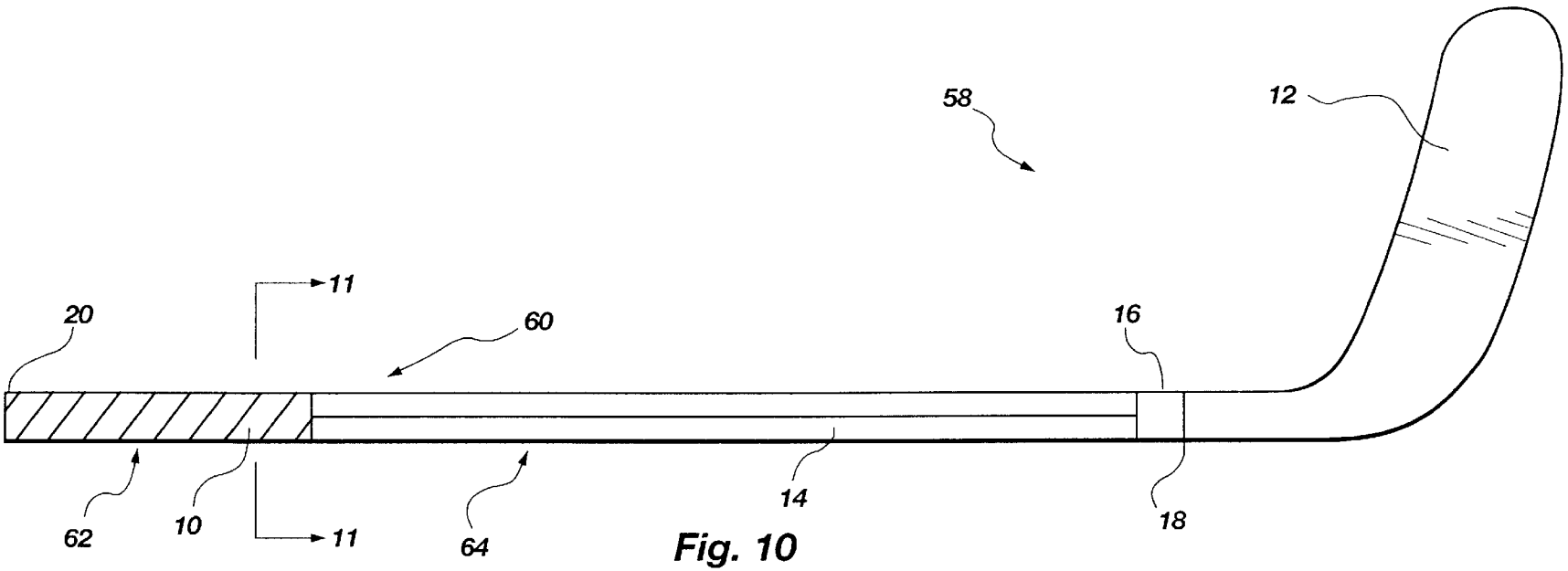
FIG. 10 is a side view of a hockey stick incorporating an alternative embodiment of the grip of the present invention.

Referring again to FIG. 1, the handle 14 advantageously may have a generally triangular cross section, similar to the grip. The advantages of having a configured handle are similar to those of having a configured grip, including a more natural and comfortable fit, and proper orientation of the grip with respect to the blade and the blade with respect to the puck. As illustrated in FIG. 10, a hockey stick, indicated generally at 58, is shown incorporating a multiple configured grip of the present invention, indicated generally at 60. The hockey stick 58 is similar in most respects to the hockey stick illustrated in FIG. 1 and described above. The stick 58 has a upper grip portion, indicated at 62, located at the proximal end 20 and generally defined by the grip 10. The stick 58 also has a lower grip portion, indicated at 64, located between the grip portion 62 and the distal end 16 and generally defined by the handle 14. The upper grip portion 62 may occupy any portion of the handle extending from the proximal end 20 and the lower grip portion 64 may occupy any portion of the handle 14.

Figure 12:
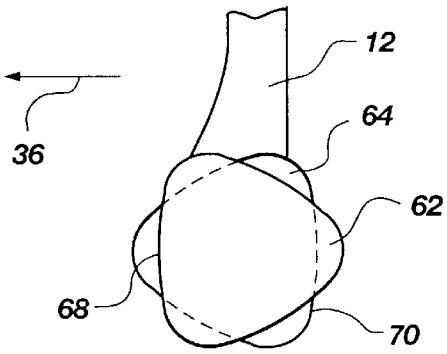
FIG. 12 is a cross sectional view of an alternative embodiment of the grip of the present invention.
Figure 11:
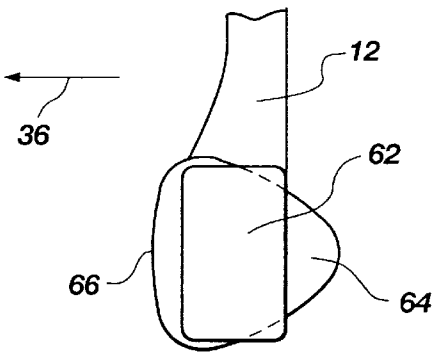
FIG. 11 is a cross sectional view of an alternative embodiment of the grip of the present invention taken along line 11—11 of FIG. 10.

As illustrated in FIGS. 11 and 12, the upper and lower grip portions 62 and 64, or the grip 10 and handle 14, advantageously have different grip orientations. In addition, they advantageously may have different grip configurations. Referring to FIG. 11, the upper grip portion 62 has a typical rectangular cross section in a typical orientation. The lower grip portion 64 has a generally triangular cross section and is oriented with one of the sides 66 facing forward. Referring to FIG. 12, the upper grip portion 62 has a generally triangular cross section and is oriented with one of the sides 68 facing forward. The lower grip portion 64 also has a generally triangular cross section and is oriented with one of the surfaces 70 facing rearward.

One of the advantages of having a grip 10 and handle 14 with different configurations and different orientations is that the upper and lower grip portions 62 and 64 each may be configured and oriented to suit either of the player's hands. Thus, the upper grip portion 62 may be configured to naturally and comfortably fit in the player's left hand. In addition, the upper portion 62 may be oriented with respect to the blade 12 so that the blade is properly oriented with respect to the puck. Similarly, the lower grip portion 64 may be configured to naturally and comfortably fit in the player's right hand. In addition, the lower portion 64 may be oriented with respect to the blade 12 so that the blade is properly oriented with respect to the puck.

Therefore, the upper and lower grip portions 62 and 64 are configured and oriented to suit the player's preference for each hand. For example, a player may feel comfortable with two different grip configurations, a typical grip configuration, or rectangular cross section, on the upper grip portion, and a triangular cross section on the lower grip portion, as illustrated in FIG. 11. As another example, a player may feel comfortable with two different grip orientations, one side 68 of a triangular configuration facing forward on the upper grip portion, and one side 70 of a triangular configuration facing rearward on the lower grip portion, as illustrated in FIG. 12.

It is of course understood that the configurations and orientations of the grips and handles shown in FIGS. 11 and 12 are only a few examples of the many different combinations that may be used.

Figure 13:
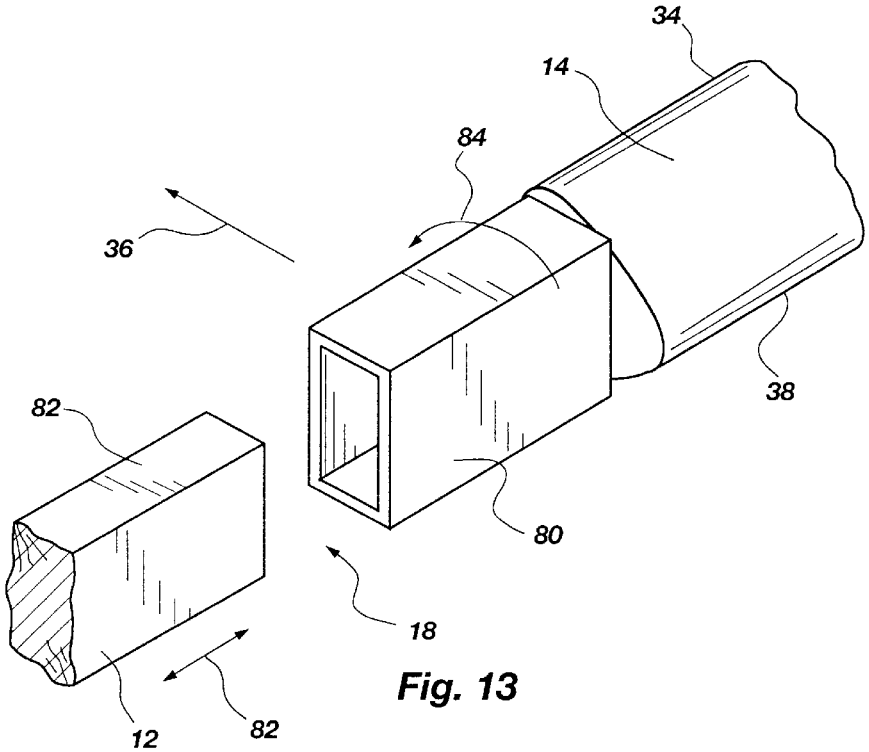
FIG. 13 is a perspective view of a preferred embodiment of a connection between a handle and a blade of the present invention.

As illustrated in FIG. 13, the connection 18 between the handle 14 and the blade 12 is shown. The conventional handle 14 has a female rectangular receiver 80, or a rectangular shaped cavity, for connecting with the blade. The blade 12 has a male rectangular receiver 82, or a rectangular shaped projection, for insertion in the female rectangular receiver 80. The male receiver 82 of the blade is typically coated with a glue. The female receiver 80 of the handle and the male receiver 82 are heated to soften the glue. The male receiver 82 is then inserted into the female receiver 80 to provide a semi-permanent bond. The connection 18 may be reheated to withdraw the male receiver.

It is of course understood that many different retaining means may be used to reasonably maintain the connection between the handle and blade, including for example a friction fit, nails, screws, etc.

Preferably, however, the handle 14 is advantageously adjustably and/or detachably coupled to the blade 12. Thus, the orientation of the grip and/or handle with respect to the blade may be selectively adjusted. One advantage of a stick with an adjustable grip and/or handle orientation is that the orientation of the grip or handle may be adjusted to meet the particular preferences of the player. Another advantage of the adjustable grip is that players may experiment with the different grip orientations to determine what works best for them.

The handle 14 or grip 10 initially may be oriented with a surface 34 facing forward and an edge 38 pointing rearward, as shown in FIGS. 2 and 13. The handle 14 may be detached or decoupled and removed from the blade 12, as indicated by arrow 82. The handle 14 may be rotated 180 degrees with respect to the blade 12, as indicated by arrow 84. The blade 12 then may be reinserted into the handle 14, again as indicated by arrow 82. The handle 14 or grip 10 is now oriented with a surface 40 facing rearward and an edge 42 facing forward, as shown in FIG. 3. Thus, the orientation of the handle and grip with respect to the blade is reversed, or rotated 180 degrees, because the male and female receivers 80 and 82 are rectangular.

Figure 14:
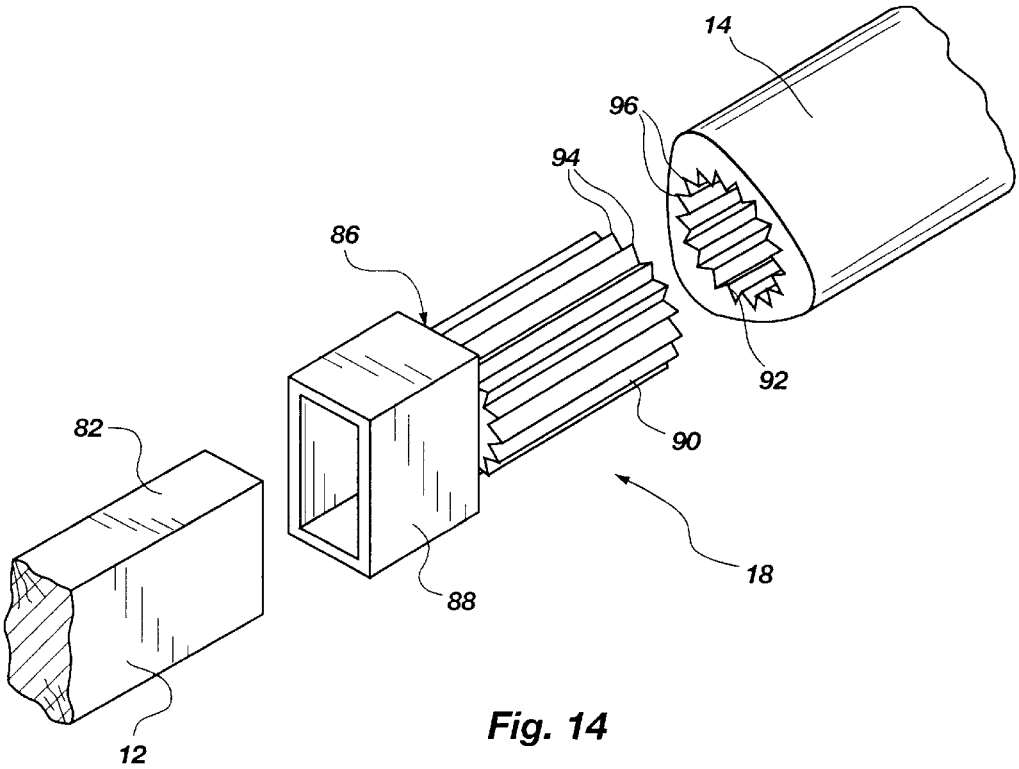
FIG. 14 is a perspective view of an alternative embodiment of a connection between a handle and a blade of the present invention.

As illustrated in FIG. 14, the connection 18 between the handle 14 and the blade 12 alternatively may have an adaptor 86. The adaptor 86 has a female rectangular receiver 88 for receiving the standard male rectangular receiver 82 of the blade. The adaptor also has a male receiver 90 for insertion into a female receiver 92 in the distal end of the handle 14. The male receiver 90 may have a plurality of teeth 94 that mate with a plurality of teeth 96 in the female receiver 92. The adaptor 86 or blade 12 may be removed from the handle 14, rotated slightly, and reinserted into the handle 14 such that a different angular orientation is obtained. The number and size of the teeth determine the various angles at which the handle may be oriented with respect to the blade.

Alternatively, the adaptor 86 may have a male square receiver and the handle may have a female square receiver. With a square receiver, four different orientations are possible, as indicated by the four different orientations shown in FIGS. 2–5 or FIGS. 6–9.

Alternatively, the adaptor 86 may have a male circular receiver and the handle 14 may have a female circular receiver. With a circular or round receiver, the blade 12 need not be removed from the handle 14 to change the orientation of the handle and/or grip. The handle may be rotated to obtain the desired orientation. In this embodiment, the handle and the blade may be adjusted through an infinite number of angular orientations.

It is of course understood that the receivers of the blade and handle may be modified as desired. For example, the receiver of the blade may be modified from its conventional rectangular shape and provided with a square or circular receiver. In such a case, the adaptor would not be necessary and the blade could be directly coupled to the handle. In addition, the blade and handle receivers may either be male or female.

The grip and handle may be made of any suitable material, for example wood, lightweight metals such as aluminum, a composite material such as a fiberglass composite, a wood/fiberglass composite, a graphite composite, etc.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A hockey stick having a handle and an attached striking portion with a striking surface, said handle comprising an elongated shank having a generally triangular cross section including three sides and three edges to imped rotation of the shank when held and to provide a recognizable orientation of the shank with respect to the striking portion, wherein the shank has at least two different orientations with respect to a striking portion of the game stick, and wherein the shank may be selectively adjusted between the two orientations.

2. A handle adapted for use as part of a hockey stick, having a striking portion with a striking surface, said handle comprising:

an elongated shank having a distal end adapted for coupling to the striking portion of the hockey stick and having a proximal end, at least a portion of the elongated shank having a generally triangular cross section including three sides and three edges; and a grip formed on the proximal end of the shank and having a generally triangular cross section including three sides and three edges to impede rotation of the grip when held and to provide a recognizable orientation of the grip with respect to the striking surface; and wherein the triangular cross section of the elongated shank has a different orientation than the triangular cross section of the grip.

3. A handle adapted for use as part of a hockey stick, having a striking portion with a striking surface, said handle comprising:

an elongated shank having a distal end adapted for coupling to the striking portion of the hockey stick and having a proximal end, at least a portion of the elongated shank having a generally triangular cross section including three sides and three edges; and a grip formed on the proximal end of the shank and having a generally triangular cross section including three sides and three edges to impede rotation of the grip when held and to provide a recognizable orientation of the grip with respect to the striking surface; and wherein the grip has at least two different orientations with respect to the striking surface, and wherein the grip may be selectively adjusted between the two orientations.

4. The handle of claim 3, wherein the elongated shank is adapted for detachably coupling to the striking portion for removing, rotating, and recoupling the elongated shank to the striking portion to adjust the orientation of the grip.

5. The handle of claim 3, wherein the elongated shank is adapted for detachably coupling to the striking portion for removing, rotating the shank 180 degrees, and recoupling the shank to the striking portion to reverse the orientation of the grip.

6. A hockey stick comprising:

an elongated handle having a distal end and a proximal end;

a blade coupled to the distal end of the handle and extending from the handle in a direction, the blade having a striking surface defining a forward direction; and a grip formed on the proximal end of the handle and having a triangular cross section including three sides and three edges to impede rotation of the grip when held and to provide a recognizable orientation of the grip with respect to the blade, wherein one of the sides of the triangular cross section of the grip is oriented generally parallel with the direction of the blade extending from the handle to provide proper orientation of the blade.

7. The game stick of claim 6, wherein the generally triangular cross section of the grip is equilateral.

8. The game stick of claim 6, wherein one side of the triangular cross section of the grip is generally perpendicular to another side.

9. The game stick of claim 6, wherein at least a portion of the handle has a triangular cross section including three sides and three edges.

10. The game stick of claim 9, wherein the triangular cross section of the handle has a different orientation than the triangular cross section of the grip.

11. The game stick of claim 6, wherein the grip has at least two different orientations with respect to the blade, and wherein the grip may be selectively adjusted between the two orientations.

12. The game stick of claim 11, wherein the handle is detachably coupled to the blade for removing, rotating, and recoupling the handle to the blade to adjust the orientation of the grip.

13. The game stick of claim 11, wherein the handle is detachably coupled to the blade for removing, rotating the handle 180 degrees, and recoupling the handle to the blade to reverse the orientation of the grip.

14. The game stick of claim 6, wherein the blade has a male rectangular receiver and the handle has a female rectangular receiver for receiving the male receiver of the blade so that the handle may be coupled to the blade in two orientations.

15. The game stick of claim 6, wherein the handle, grip and blade form a hockey stick.

16. The hockey stick of claim 6, wherein one of the edges of the triangular cross section is a forward edge and points generally in the forward direction to provide proper orientation of the blade.

17. The hockey stick of claim 6, wherein one of the sides of the triangular cross section is a forward side and faces forward generally in the forward direction to provide proper orientation of the blade.

18. A handle adapted for use with a hockey stick having a striking portion with a striking surface, said handle comprising:

an elongated shank having a distal end adapted for coupling to the striking portion, a proximal end, an upper grip portion located near the proximal end, and a lower grip portion located between the upper grip portion and the distal end;

wherein at least one of the upper and lower grip portions have a generally triangular cross section including three sides and three edges to impede rotation of the grip and handle portions when held and to provide a recognizable orientation of the grip and handle portions with respect to the striking surface; and wherein the upper and lower grip portions have at least two different orientations with respect to the striking portion.

19. The handle of claim 18, wherein the lower grip portion has a generally triangular cross section, and wherein the upper grip portion has a generally rectangular cross section.

20. The handle of claim 18, wherein the upper and lower grip portions may be selectively adjusted between the two different orientations.

21. A game stick comprising:

a blade having a striking surface defining a forward direction;

an elongated handle coupled to the blade at a distal end and having a proximal end; and a grip formed on the proximal end of the handle and having a triangular cross section including three sides and three edges to impede rotation of the grip when held and to provide a recognizable orientation of the grip with respect to the blade; and wherein the handle is adjustably coupled to the blade and wherein the handle may be selectively adjusted with respect to the blade such that the triangular cross section of the grip has at least two different orientations with respect to the blade.

22. The game stick of claim 21, wherein triangular cross section of the grip is adjustable between one orientation where a side of the triangular cross section faces forward generally in the same direction as the striking surface, and another orientation wherein one edge of the triangular cross section points forward generally in the same direction as the striking surface.

* * * * *